US009109466B2

(12) United States Patent
Lo et al.

(10) Patent No.: US 9,109,466 B2
(45) Date of Patent: Aug. 18, 2015

(54) DIFFUSER WITH BACKWARD FACING STEP HAVING VARYING STEP HEIGHT

(75) Inventors: Kin Pong Lo, Fremont, CA (US); John K. Eaton, Stanford, CA (US)

(73) Assignee: THE BOARD OF TRUSTEES OF THE LELAND STANFORD JUNIOR UNIVERSITY, Palo Alto, CA (US)

( * ) Notice: Subject to any disclaimer, the term of this patent is extended or adjusted under 35 U.S.C. 154(b) by 625 days.

(21) Appl. No.: 13/468,157

(22) Filed: May 10, 2012

(65) Prior Publication Data

US 2013/0019583 A1 Jan. 24, 2013

Related U.S. Application Data

(60) Provisional application No. 61/510,551, filed on Jul. 22, 2011.

(51) Int. Cl.
*F01D 25/30* (2006.01)

(52) U.S. Cl.
CPC ..... *F01D 25/30* (2013.01); *F05D 2270/17* (2013.01); *F05D 2270/173* (2013.01)

(58) Field of Classification Search
CPC ..... F01D 5/143; F01D 5/145; F01D 25/30; F01D 9/00; F01D 9/02; F01D 9/04; F02K 1/48; F02K 1/80; F05D 2270/173; F05D 2270/17
USPC ..... 60/39.182, 770, 39.5, 264, 771; 239/265.11, 601; 415/207, 211.2, 415/208.2, 176–178, 914
See application file for complete search history.

(56) References Cited

U.S. PATENT DOCUMENTS

| | | | | |
|---|---|---|---|---|
| 2,956,400 | A * | 10/1960 | Ferri | 239/265.39 |
| 4,677,828 | A | 7/1987 | Matthews et al. | |
| 5,110,560 | A * | 5/1992 | Presz et al. | 422/176 |
| 5,338,155 | A | 8/1994 | Kreitmeier | |
| 5,642,614 | A | 7/1997 | Bozzuto et al. | |
| 5,791,136 | A | 8/1998 | Utamura et al. | |
| 7,272,930 | B2 | 9/2007 | Wiebe et al. | |

(Continued)

FOREIGN PATENT DOCUMENTS

| | | | |
|---|---|---|---|
| CN | 1123879 | A | 6/1996 |
| EP | 244335 | A2 | 11/1987 |
| EP | 1431516 | A2 | 6/2004 |

OTHER PUBLICATIONS

Bhattacharjee, S. et al. Modification of Vortex Interactions in a Reattaching Separated Flow. AIAA Journal, vol. 24, No. 4, Apr. 1986, p. 623-629.

(Continued)

*Primary Examiner* — Steven Sutherland

(57) ABSTRACT

A diffuser (30) expanding a gas flow (F) upstream of a heat recovery steam generator (32) of a combined cycle power plant (34). An outer wall (44) of the diffuser includes a smoothly lofted backward facing step (46) effective to fix a location of a flow recirculation bubble (56) under conditions conducive to flow separation. The step has a varying step height ($H_{peak}$, $H_{valley}$) about a circumference of the step edge (62). The varying step height segments the recirculation bubble into small cells (66) located downstream of each peak (58) of the step height and reducing a reattachment length (L) of the bubble, thereby facilitating a reduction of the overall length of the diffuser.

9 Claims, 2 Drawing Sheets

(56) References Cited

U.S. PATENT DOCUMENTS

| | | | | |
|---|---|---|---|---|
| 7,296,411 | B2 * | 11/2007 | Segota et al. | 60/770 |
| 7,735,601 | B1 * | 6/2010 | Stieger et al. | 181/213 |
| 2010/0021291 | A1 | 1/2010 | Beeck | |
| 2011/0056179 | A1 | 3/2011 | Orosa | |
| 2011/0058939 | A1 * | 3/2011 | Orosa et al. | 415/208.1 |
| 2011/0158798 | A1 | 6/2011 | Kirtley | |

OTHER PUBLICATIONS

Chun, K.B. et al. Control of Turbulent Separated Flow Over a Backward-facing Step by Local Forcing. Experiments in Fluids, vol. 21, 1996, pp. 417-426.

Park, Hyungmin, et al. Mixing Enhancement Behind a Backward-facing Step Using Tabs. Physics of Fluids, vol. 19, 105103, (2007). American Institute of Physics (2007).

Azad, Ram S. Turbulent Flow in a Conical Diffuser: A Review. Experimental Thermal and Fluid Science, 1996, 13: 318-337, Elsevier Science, Inc. (1996).

Elkins, C.J. et al 4D Magnetic Resonance Velocimetry for Mean Velocity Measurements in Complex Turbulent Flows. Experiments in Fluids, 34 (2003), pp. 494-503.

Klein, A. Review: Effects of Inlet Conditions on Conical-Diffuser Performance. Transactions of the ASME, 250/vol. 103, Jun. 1981.

Sovran, Gino, et al. Experimentally Determined Optimum Geometries for Rectilinear Diffusers with Rectangular, Conical or Annular Cross-Section. Optimum Geometries for Rectilinear Diffusers. Fluid Mechanics of Internal Flow (1967), p. 270-312.

Castro, Zachira. Active Control of Diffuser. Proposal. 16.621, Spring 1994. (Mar. 15, 1994).

* cited by examiner

DIFFUSER WITH BACKWARD FACING STEP HAVING VARYING STEP HEIGHT

This application claims benefit of the 22 Jul. 2011 filing date of U.S. provisional patent application No. 61/510,551.

FIELD OF THE INVENTION

This invention relates generally to the field of flow diffusers, and more particularly to a flow diffuser such as may be used to expand and to slow the velocity of a gas flow between a gas turbine and a heat recovery steam generator in a combined cycle power plant.

BACKGROUND OF THE INVENTION

Diffusers are devices used to slow the velocity of a fluid flow by directing the fluid through a flow path of increasing cross-sectional area in the direction of the flow. As the flow area expands and the flow velocity decreases, the dynamic head of the fluid decreases and the static head of the fluid increases.

In a combined cycle power plant, the hot exhaust gas from a gas turbine engine is directed into a heat recovery steam generator (HRSG) in order to transfer heat from the hot gas, thereby cooling the gas before it is exhausted into the atmosphere. The recovered heat warms water passing through tubes of the HRSG and produces steam, which is then used to drive a steam turbine. It is known to install a diffuser between the exit of the gas turbine and the entrance of the HRSG in order to protect the tubes from excessively high velocity gas and to improve the heat transfer performance of the HRSG. U.S. Pat. No. 7,272,930 describes one such combined cycle power plant diffuser application.

A typical diffuser used upstream of a HRSG in a combined cycle power plant includes an outer wall having a generally conical shape which expands in diameter in the downstream direction. Two parameters are used to describe such a diffuser: the area expansion ratio (outlet cross-sectional area divided by inlet cross-sectional area) and the expansion angle (or half-angle, expressed as the angle defined between one side of the wall and a flow direction centerline as viewed in cross-section). These two parameters control the overall length of the diffuser necessary to obtain a desired degree of flow slowing. If the expansion angle is too small, the diffuser is excessively long, which is undesirable in a power plant for space and cost reasons. If the expansion angle is too large, the flow separates from the wall and generates a reverse flow region along the wall, thereby reducing the functionality of the diffuser. The separated flow is unsteady and the separation bubble can move around in the diffuser, adversely affecting the downstream HRSG. Thus, diffusers for combined cycle power plants are generally designed to be conservatively long in order to avoid flow separation over an entire range of power plant operating parameters.

Studies have shown that it is possible to actively control flow separation in a diffuser by exciting vortex interactions in the separated shear layer, such as with acoustic energy, resulting in a reduction of the reattachment length. An active solution for a combined cycle power plant application is difficult because the shear layer can move within the diffuser, and because acoustic excitation requires knowledge of the optimal forcing frequency and amplitude in order to avoid potentially causing the reattachment length to grow. Active solutions also have the disadvantage of consuming power, and the imposed energy may have an adverse impact on the mechanical components of the system.

Studies have also shown that flow trip tabs can reduce flow separation reattachment length of a shear layer by generating longitudinal vortex pairs which increase mixing. A flow tab solution for a combined cycle power plant application is also difficult due to the uncertain location of the shear layer, and such tabs would create a relatively high energy loss due to the abrupt flow disturbances caused by the tabs.

BRIEF DESCRIPTION OF THE DRAWINGS

The invention is explained in the following description in view of the drawings that show.

DETAILED DESCRIPTION OF THE INVENTION

The present inventors have developed an innovative solution for flow separation control in a conical diffuser, such as may be used upstream of a heat recovery steam generator (HRSG) in a combined cycle power plant. Rather than trying to anticipate the location of a flow separation region under the many varying operating conditions of the diffuser, the solution of the present invention incorporates a backward facing step into the diffuser wall. The step is effective to stimulate the formation and reattachment of a downstream flow separation bubble under conditions conducive to flow separation in order to fix the location of the separation within the diffuser, and to do so with a minimal flow energy loss and with a minimum diffuser length. Moreover, the height of the step is varied around the circumference of the diffuser wall in a peak/valley pattern such that the resulting separation bubble is segmented into a series of smaller cells, with one cell being located behind each peak in the step.

Embodiments of the present invention are described below using the following terminology. Flow at any given cross section is generally considered to be separated from the wall of the diffuser when the total reverse flow area is 1% or more of the total flow area. A backward facing step is understood to be an abrupt increase in flow area in a downstream direction causing downstream recirculation. A smoothly lofted wavy backward facing step is one with a non-circular perturbation section leading to the step edge, where the perturbation section transitions from a circular to a non-circular cross-sectional profile without creating any appreciable upstream recirculation region. The thickness of a boundary layer is considered to be the distance from the wall at which the viscous flow velocity is 99% of the free stream velocity. The term "generally conical shaped" means a cone shape having circular or annular cross sections but allowing for some local areas to have variations in the cone shape, such as constant diameter regions, so long as the overall shape expands the cross section from inlet to outlet.

Figure 1:
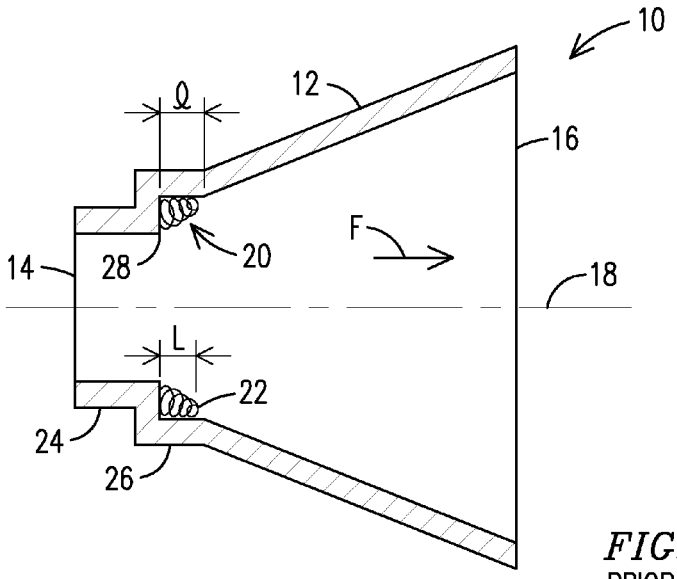
FIG. 1 PRIOR ART
FIG. 1 is a cross sectional view of a prior art diffuser.

A prior art diffuser 10 is illustrated in cross section in FIG. 1. The diffuser 10 has a generally conical shaped outer wall 12 defining an inlet 14 and an outlet 16 with a generally circular and expanding cross-sectional area extending in a direction of a fluid flow F about a flow centerline 18. The wall 12 includes a backward facing step 20 extending along a complete circumference of the wall 12. A flow separation bubble 22 develops downstream of the step 20 between the wall 12 and the fluid flow F under conditions conducive to the occurrence of flow separation. The step 20 is defined by a difference in diameters between two constant diameter regions 24, 26 on either side of the step edge 28 and is said to have a step length/equal to the length of the downstream constant diameter region 26. The bubble has a reattachment length L.

Figure 2:
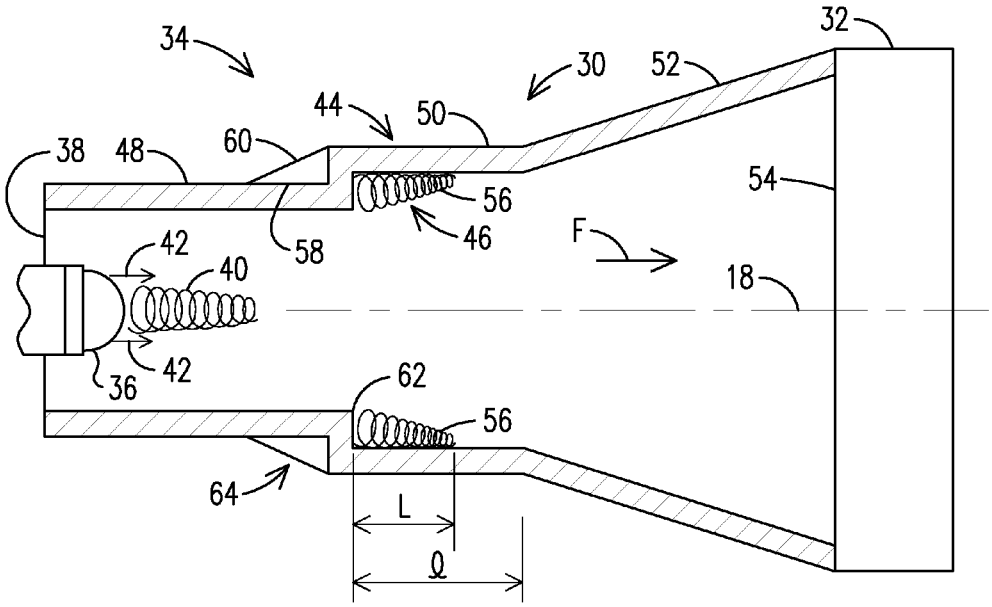
FIG. 2 is a partial cross sectional view of a combined cycle power plant showing the position of a diffuser between a turbine and a heat recovery steam generator in accordance with an embodiment of the invention.

An embodiment of the invention is illustrated in FIG. 2 where a generally conical diffuser 30 is illustrated in cross section as being attached to a downstream HRSG 32 in a combined cycle power plant 34. A shaft bearing hub 36 of a gas turbine of the plant 34 is disposed as a center body at the inlet 38 of the diffuser 30, causing the fluid flow F to have a generally annular cross sectional geometry at the inlet 38. A separation bubble 40 is present in the immediate wake of the hub 36. A Coanda jet flow 42 may be introduced through the hub 36 to reduce the size of the bubble 40, as is known in the art. The outer wall 44 of the diffuser 30 includes a smoothly lofted backward facing step 46 extending along a circumference of the wall 44. In this embodiment, the step 46 is disposed between a first constant diameter region 48 located immediately downstream of the inlet, and a second constant diameter region 50 having a diameter larger than the first constant diameter region 48 to define the step 46 there between. A diffusing region 52 is disposed between the second constant diameter region 50 and the outlet 54 of the diffuser 30 which directs the flow F to the HRSG 32. Flow separates at the step 46 and creates a recirculation region 56 (bubble) downstream of the step 46, thereby defining the location of the bubble 56 during operating conditions conducive to its formation. The reattachment length L is less than the step length/such that the bubble 56 is completely closed upstream of the diffusing region 52.

Figure 3:
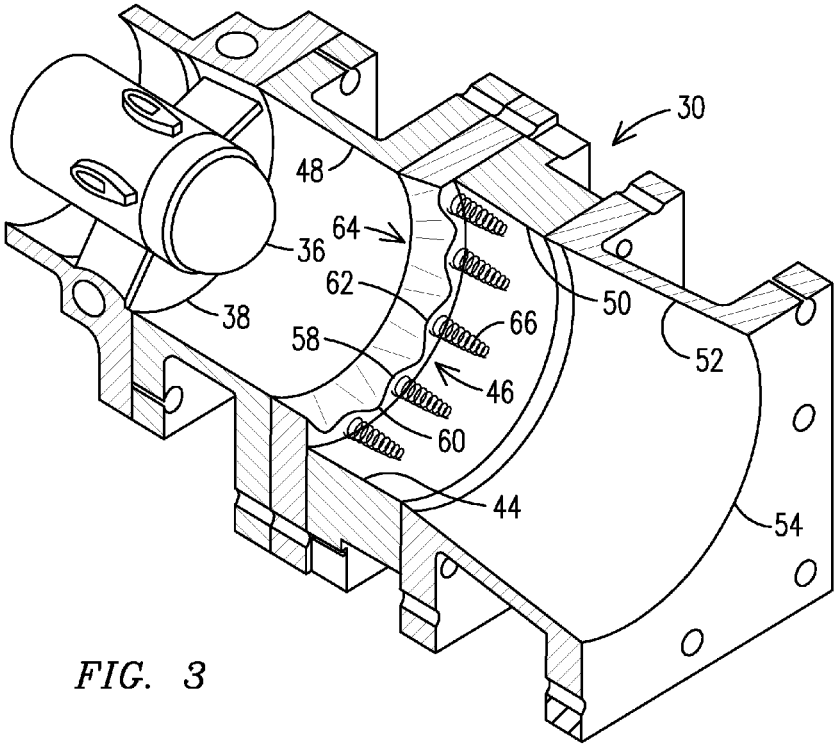
FIG. 3 is a partial perspective view of the power plant of FIG. 2 showing the diffuser and turbine shaft bearing hub located at the downstream end of the turbine and just upstream of the diffuser.
Figure 4:
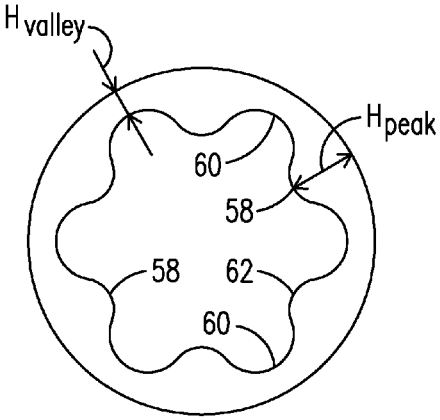
FIG. 4 is an end view of the edge of a smoothly lofted backward facing step in a diffuser wall having a step height which varies in a sinusoidal shape and having a minimum step height of greater than zero.
Figure 5:
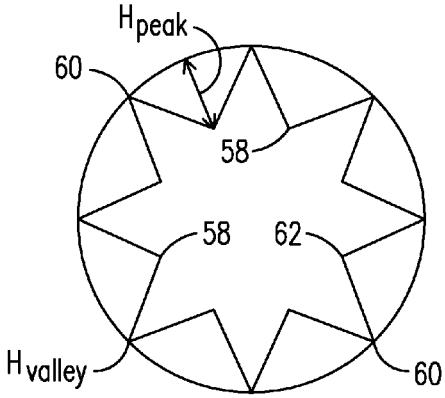
FIG. 5 is an end view of the edge of a smoothly lofted backward facing step in a diffuser wall having a step height which varies in a triangular shape and having a minimum step height of zero.

The shape of the smoothly lofted backward facing step 46 of the embodiment of FIG. 2 can be appreciated in the perspective view of FIG. 3, which is presented with the HRSG 32 removed for clarity, and in FIG. 4 which is a sectional view taken across the flow centerline 18 looking upstream at the step edge 62. There it can be seen that the step 46 is wavy in shape and has a periodically varying height along the circumference of the wall 44. In this embodiment, the height has a sinusoidal shape around the entire circumference, with alternating peaks 58 having a relatively greater step height $H_{peak}$ and valleys 60 having a relatively smaller step height $H_{valley}$. FIG. 5 is a view similar to FIG. 4 but for an embodiment where the step height varies in a triangular shape which may be easier to manufacture than the sinusoidal shape. One will appreciate that the variation in step height may take any shape, may extend around the entire circumference or only part of the circumference, and may be symmetric about the flow axis 18 or not symmetric in various embodiments as may be dictated by a specific application's flow conditions and structural requirements.

In the embodiment of FIG. 2, the step 46 is formed in a perturbation region 64 of the outer wall 44 where the diameter of the upstream constant diameter region 48 is maintained at the peaks 58 throughout the perturbation region 64 and the valleys 60 are smoothly lofted outward from that diameter to define a minimum step height $H_{valley}$ at the step edge 62. The minimum step height is greater than zero in the embodiment of FIG. 4 and is equal to zero in the embodiment of FIG. 5. Other embodiments may smoothly loft the peaks 58 across the perturbation region 48 to a somewhat larger or smaller diameter than that of the upstream region.

The periodically varying step heights of the embodiments of FIGS. 2-5 function to reduce the reattachment length L of the bubble 56 when compared to a comparable embodiment where the step height remains at $H_{peak}$. This comes about because the flow travelling through the valleys 60 follows the direction of the valley slope toward the downstream wall 50 and generates a very small or no recirculation region downstream of the valleys 60, thereby segregating the recirculation region 56 into a series of smaller cells 66, with one cell 66 being located downstream of each peak 58 at the step edge 62. This is expected to reduce large scale unsteadiness in the flow and to reduce the magnitude of mechanical forces generated by the bubble. Testing of this geometry has revealed that the step separation bubble 56 in an embodiment with varying step height has a distinct peak and valley pattern, and the shear layer that bounds the bubble follows the shape of the wavy edge 62. A pair of counter-rotating vortices is observed downstream of each peak 58. These vortex pairs have the opposite sense of a horseshoe vortex. They entrain fluid from the separation bubble to the main flow and carry fluid from the main flow to the recirculation regions, thereby enhancing mixing across the shear layer. They also interact with each other and their corresponding images due to the induced velocity. This results in large scale fluid motion across the shear layer which allows the separated shear layer to reattach quickly.

Advantageously, a diffuser designed in accordance with embodiments of the present invention may be shorter than a comparable prior art design due to a reduction of the bubble reattachment length. The wavy height backward facing step of the present invention has been shown experimentally to function similarly when used in a conical diffuser with or without Coanda blowing from a center body at the diffuser inlet. When a wavy step was modeled to have a height varying symmetrically about the circumference from $H_{peak}$ to $H_{valley}$, the step bubble reattachment length (L) reduced by almost half when compared to a similar device with a constant step height of $H_{peak}$.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A diffuser comprising:

a generally conical shaped outer wall defining an inlet, a generally expanding cross-sectional area in a flow direction, and an outlet larger than the inlet;

a first constant diameter region downstream of the inlet;

a second constant diameter region comprising a diameter larger than the first constant diameter region and disposed downstream of the first constant diameter region;

a diffusing region disposed between the second constant diameter region and the outlet;

the wall comprising a backward facing step defined by the first constant diameter region and the second constant diameter region, the backward facing step extending along a circumference of the wall, the step effective to fix a location of a flow separation between the wall and a fluid flowing through the diffuser;

wherein the step comprises a periodically varying height along the circumference, and wherein the step height is measured to the second constant diameter region, wherein the diffuser further comprises a perturbation region comprising peaks and valleys disposed between the first and second constant diameter regions and defining the periodically varying step height there between, and wherein the backward facing step is formed in the perturbation region where the diameter of the first constant diameter region is maintained at the peaks throughout the perturbation region and the valleys are smoothly lofted outward from the diameter of the first constant diameter region to define a minimum step height at a step edge.

2. The diffuser of claim 1, wherein the step height comprises a sinusoidal shape.

3. The diffuser of claim 1, wherein the step height comprises a triangular shape.

4. The diffuser of claim 3 installed in a combined cycle power plant, further comprising:

a bearing hub of a gas turbine of the combined cycle power plant disposed as a center body in the inlet and creating a center body separation region downstream of the inlet; and a Coanda flow directed from the bearing hub effective to decrease a size of the center body separation region.

5. The diffuser of claim 1, wherein the valleys extend to the second diameter and define periodic zero height portions of the step.

6. The diffuser of claim 1, wherein the valleys extend to a diameter between the first and second diameters and define a minimum step height of greater than zero.

7. The diffuser of claim 1, wherein the step extends along 360° of the circumference.

8. The diffuser of claim 1, wherein the step extends along 360° of the circumference and the periodically varying height is axisymmetrical about a flow centerline.

9. A combined cycle power plant comprising the diffuser of claim 1 disposed between an outlet of a gas turbine and an inlet of a heat recovery steam generator of the plant.

* * * * *